United States Patent [19]

Sarto

[11] 4,372,261

[45] Feb. 8, 1983

[54] PRE-START ENGINE HEAT SYSTEM

[75] Inventor: Jorma O. Sarto, Orchard Lake, Mich.

[73] Assignee: Chrysler Corporation, Highland Park, Mich.

[21] Appl. No.: 196,804

[22] Filed: Oct. 14, 1980

[51] Int. Cl.[3] ..... F02N 17/00

[52] U.S. Cl. ..... 123/142.5 E; 123/179 B; 123/549; 123/552; 180/286

[58] Field of Search ..... 123/142.5 E, 179 B, 123/179 BG, 549, 552; 180/286

[56] References Cited

U.S. PATENT DOCUMENTS

| | | | |
|---|---|---|---|
| 2,177,840 | 10/1939 | Roualet | 123/142.5 E |
| 3,071,125 | 1/1963 | Leaver et al. | 123/179 B |
| 3,248,555 | 4/1966 | Fried | 123/179 B |
| 3,443,557 | 5/1969 | Hebert | 123/129 B |
| 3,455,403 | 7/1969 | Hawthorne | 123/179 B |
| 3,850,152 | 11/1974 | Hollins | 123/549 |
| 4,122,354 | 10/1978 | Howland | 123/179 B |
| 4,194,476 | 3/1980 | Lombardi et al. | 123/552 |
| 4,261,309 | 4/1981 | Bcondi | 123/179 B |
| 4,291,653 | 9/1981 | Tucker | 123/179 BG |

FOREIGN PATENT DOCUMENTS

| | | | |
|---|---|---|---|
| 2393947 | 1/1979 | France | 123/142.5 E |

*Primary Examiner*—Ira S. Lazarus

*Attorney, Agent, or Firm*—Newtson & Dundas

[57] ABSTRACT

In an automobile having a self-starting motor and a source of an electrical energy, a heating grid for vaporizing fuel and therefore promoting easier starting. The heating grid is selectively energized by the electrical energy source and controlled by an engine start anticipated system including switch means responsive to vehicle operator initiated actions so that the heating grid is energized prior to engine starting attempts.

3 Claims, 3 Drawing Figures

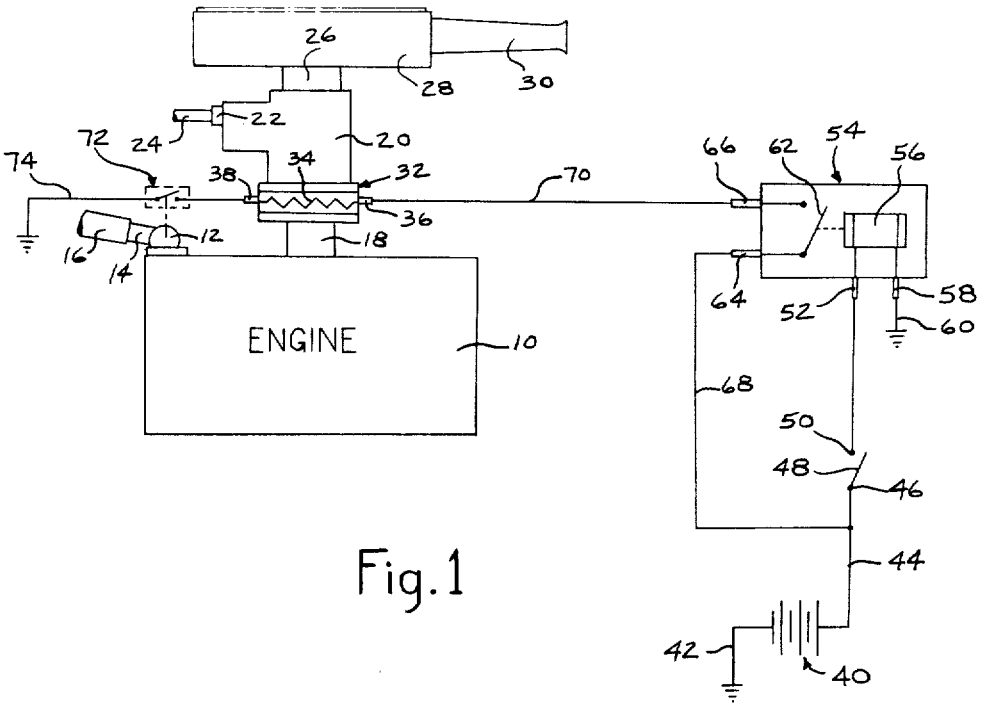
Fig. 1
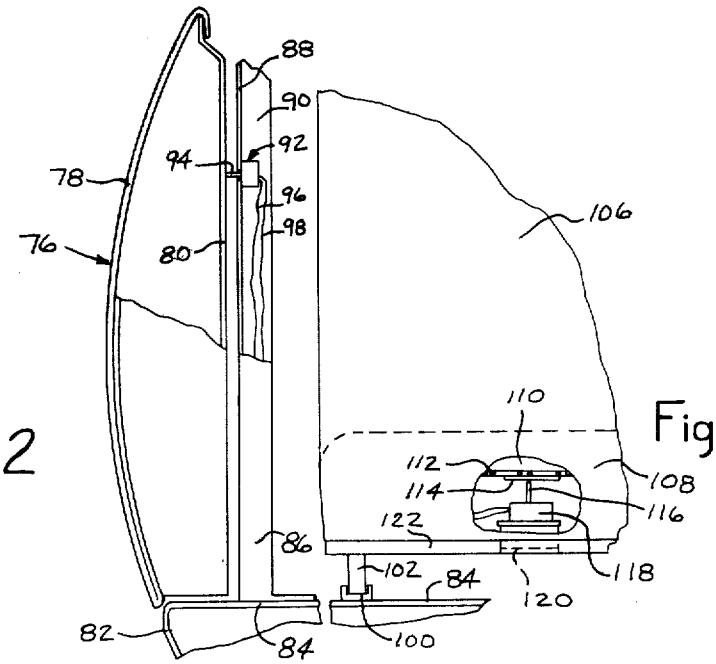
Fig. 2
Fig. 3

PRE-START ENGINE HEAT SYSTEM

BACKGROUND OF THE INVENTION

This application concerns automobile engines and particularly an automobile engine including an air and fuel heater which is energized through an engine start anticipator prior to any attempts to start the engine.

It is known to utilize electrical heaters for vaporizing fuel and for heating air and fuel entering an engine. This has been previously contemplated to promote engine starting, particularly in cold weather. Previous heaters have utilized resistance wire grids. Another known type of heater utilizes ceramic material which is molded or extruded into a grid configuration. An example of this type of heater is found in U.S. Pat. No. 3,846,723 and is assigned to Texas Instruments. This type of heating element is desirable in that the resistance is low at low temperatures but as the grid increases in temperature, the resistance also increases thereby limiting the maximum electrical current utilized after the grid reaches an operating temperature. A problem with electrically energized heating grids for heating fuel and air is the delay between energization of the heating grid and achieving a satisfactory and workable temperature thereof so that fuel is evaporated. When a heating grid is energized and an engine is immediately cranked in cold weather, an appreciable period of time extends before the heating grid becomes effective to aid in engine starting.

It has been found that a vehicle engine equipped with an early fuel evaporator as described heretofore will substantially decrease the period of time necessary for the starter motor to operate. This of course extends its durability and imposes less strain on the battery and other electrical components. The conventional manner of energizing the early fuel evaporator is by a circuit controlled by the vehicle ignition switch. This type of control system does decrease starter operating to some extent but is wasteful because the early fuel evaporator needs a short period of time in which to reach operating temperatures. When the ignition switch is first switched on the early fuel evaporator is energized but almost immediately thereafter the engine starter motor is also energized during a normal start-up. It is desirable to provide a system which energized the early fuel evaporator unit a short period of time prior to operating the vehicle starter motor. To this end the subject early fuel vaporizer system has been developed. A pre-ignition anticipator controls the heater. One desirable pre-ignition anticipator utilizes switch means activated by opening of the driver's door as he or she enters the vehicle. It is also possible to utilize switch means operated by the door opening handle mechanism. Another anticipator might take the form of switch means which is activated by the driver's weight on the seat cushion. The purpose of utilizing any of the aforementioned anticipators is to activate the fuel vaporizer heating unit a short period of time before actual operation of the vehicle starter.

Therefore, an object of the present invention is to provide a fuel-air heating system for a vehicle and activated prior to start cranking to permit desirable high temperatures to be attained.

A further object of the present invention is to provide a vehicle fuel-air heating system utilizing an electrically heated grid located downstream from fuel introduction means such as a carburetor which initiates the heat cycle a short period of time prior to actual operation of the vehicle starter motor so that the heater will attain a proper operating temperature prior to attempted engine starts.

Further objects and advantages of the present invention will be more readily apparent from a reading of the following detailed description of preferred embodiments, reference being had to the accompanying drawings in which embodiments are illustrated.

IN THE DRAWINGS

FIG. 1 is a somewhat schematic view of a vehicle engine including an early fuel vaporizer or heater unit and a pre-ignition anticipator control therefor;

FIG. 2 is a fragmentary sectioned view of a vehicle including one type of pre-ignition anticipator and FIG. 3 is a sectioned view of a second type of pre-ignition anticipator.

In FIG. 1, an automobile engine 10 is illustrated in block diagram form. The engine is of the typical water-cooled type and includes a coolant outlet fitting 12 for discharging coolant from the engine through an outlet tube 14 and into an outlet hose 16. The engine also includes an intake manifold 18 for introducing a fuel-air mixture to the engine cylinders. A carburetor 20 or other similar device is utilized and includes a fitting 22 attached to a fuel line 24 for receiving fuel from a tank (not shown). The carburetor 20 includes an air intake portion 26 which is attached to an air cleaner housing 28. The air cleaner housing 28 is of conventional hollow design including an air filter element therein (not visible) and having an intake snorkel tube 30.

Located between the intake manifold 18 and the carburetor 20, is a fuel and air heater 32. Basically, the fuel and air heater 32 includes a perforated and electrically heated grid which is shown schematically by the numeral 34. The grid 34 is connected to terminals 36 and 38 which are insulated from the engine or intake manifold.

The heater 32 is energized by a circuit which includes the vehicle battery 40 which is grounded by a conductor 42 and connected by a conductor 44 to one terminal 46 of a pre-ignition anticipator or control switch 48. The second terminal 50 of the control switch 48 is connected to a terminal 52 of a control relay assembly 54. The control relay assembly 54 includes a solenoid coil 56 connected between the terminal 52 and a second terminal 58 which in turn is grounded by a conductor 60. A contact making member 62 is moved by energization of the solenoid 56 to connect terminals 64 and 66 of the relay assembly 54. One of the terminals 64 is connected by a conductor 68 to the positive or non-grounded side of the battery 40. The other terminal 66 of the relay 54 is electrically connected by conductor 70 to one terminal 36 of the grid 34. The other terminal 38 of grid 34 is connected to one side of a thermally responsive switch assembly 72. The other side of the switch assembly 72 is grounded by conductor 74.

In FIG. 2, an automobile door 76 having an outer panel 78 and an inner panel 80 is attached in a conventional hinged manner (not shown) to a vehicle body. The body includes a panel assembly 82 located below the door 76 which is attached to the vehicle floor 84 and extends beneath the passenger interior of the vehicle. Vehicle floor 84 supports a door frame member 86 including an outer wall portion 88 and a laterally extending wall portion 90. The outer wall portion 88 supports a pre-ignition anticipator means or switch 92 of the type including a plunger 94 for activating switch parts. A pair of conductors 96 and 98 are connected when the vehicle door is opened.

In FIG. 3, a second pre-ignition anticipator is shown. As in FIG. 2, the vehicle floor 84 is shown and it supports a track member 100 in which a seat leg or support 102 resides. The leg 102 supports a front seal assembly shown from the backside in FIG. 3. The seat assembly includes a generally vertical seatback portion 106 and a generally horizontal seat cushion portion 108. The seat cushion portion 108 includes a thick foam type material 110 which is engaged on its underside by a wire seat frame 112. The seat frame 112 includes a flat bearing pad 114 adapted to engage the plunger 116 of an anticipator switch 118. Switch 118 is supported by a bracket assembly 120 attached to a lower member 122 of the seat cushion 108.

OPERATION

As soon as the door 76 in FIG. 2 is opened or a predetermined sufficient weight exerts a force upon the seat cushion 108 in FIG. 3, the switch assemblies 92 and 118 respectively, are closed so as to activate the early fuel evaporator device as described hereinafter. In FIG. 1, the anticipator switches 82 and 118 are schematically represented as switch 48. Note that when switch 48 is closed, a circuit is completed from the battery to the solenoid coil 56. The energization of solenoid coil 56 causes the contact making member 62 thereof to connect the terminals 64 and 66. Consequently, a circuit for grid 34 extends from the battery through the contact making member 62 and through the thermally responsive switch assembly 72. Since it is unnecessary to energize grid 34 after the engine 10 attains a normal operating temperature, the thermally responsive switch assembly 72 opens at such engine temperatures but is closed when the coolant temperature falls below a given temperature. When the switch assembly 72 is closed, energization of grid 34 takes place. Soon thereafter, the grid attains an operating temperature of about 310° F. In tests, it is shown that no more than ten seconds is necessary to attain the aforesaid temperature. During this short period the vehicle operator has just progressed to the point of inserting the ignition key to begin operation of the starter motor. It is estimated that it normally takes a vehicle operator at least ten seconds to initiate starter operation. Consequently, there is ample time for the grid to be heated before an engine start operation.

The basic EFE system has been described heretofore, however, a number of variations or modifications readily come to mind. Since the EFE system is primarily a cold weather starting assist, it may be desirable to include an ambient air temperature switch in the system so that the EFE heater only works when necessary. On the other hand, however, some engines and fuel systems therefore need more starting assistance even in warmer weather. Therefore, with such engines, it may be desirable to connect the EFE energization circuit and the ignition switch together so that heating occurs when the engine is running.

Concerning the control assembly 54, it is certainly possible to provide various modifications. The control shown is energized by momentary closing of the anticipator 48 and resultantly the heating circuit remains active until terminated by sensor 72. Numerous "lock-in" type controls are available to provide this functional operation. Another method of achieving desired starting assistance would be to utilize a "timing" type control which would cut-off the heater after a certain time period.

Certainly "less automatic" in operation but very feasible would be the use of a pre-start control switch which a vehicle driver could activate prior to starting the vehicle. Along the same lines, a control could be used which would delay activation of the starting motor when the ignition key is turned until the EFE heater achieves an effective temperature. Thus, an operator effected anticipator may take several forms and still provide satisfactory service of the EFE heater system.

Although the pre-ignition anticipator system has been illustrated in one basic embodiment, other arrangements and embodiments are contemplated and certainly fall within the scope of the following claims which define the invention.

I claim:

1. In a vehicle with an engine having self-starting means activated by manual efforts of an operator while in a normal driving position, an engine fluid inlet preheating system adapted to be initiated prior to said manual starting efforts, comprising: an electrically powered heating grid across the engine fluid inlet; a battery in circuit with the heating grid for energizing same; control circuit means between the battery and heating grid for initiating energization prior to said manual starting efforts of the vehicle operator, the control circuit including switch means operated in response to and incidental with an anticipatory action of the vehicle operator in entering the vehicle whereas the heating grid is preheated by electrical power from the battery during the interval between closing the switch by the operator's incidental anticipatory action and the manual engine starting efforts by the operator.

2. The subject matter as set forth in claim 1 in which the control switch is so placed with respect to a vehicle entry for the operator and a door means therefore that the incidental anticipatory action occurs as the operator prepares to enter the vehicle.

3. The subject matter as set forth in claim 1 in which the control switch is so placed with respect to seat means for the vehicle operator that the incidental anticipatory action occurs when the operator places his weight on the seat means.

* * * * *